US005685096A

United States Patent [19]

Horiuchi

[11] Patent Number: 5,685,096

[45] **Date of Patent: *Nov. 11, 1997**

[54] SWIMMING TOY FISH AQUARIUM HAVING MAGNETIC DRIVE SYSTEM FOR MAGNETICALLY DRIVING THE TOY FISH IN THE AQUARIUM

[75] Inventor: Shigeyuki Horiuchi, Koshigaya, Japan

[73] Assignee: Masudaya Corporation, Tokyo, Japan

[ * ] Notice: The term of this patent shall not extend beyond the expiration date of Pat. No. 5,463,826.

[21] Appl. No.: 552,263

[22] Filed: Nov. 2, 1995

Related U.S. Application Data

[63] Continuation-in-part of Ser. No. 226,022, Apr. 11, 1994, Pat. No. 5,463,826, which is a continuation-in-part of Ser. No. 41,566, Apr. 2, 1993, Pat. No. 5,301,444.

[51] Int. Cl.[6] ..... G09F 19/00

[52] U.S. Cl. ..... 40/426; 446/134

[58] Field of Search ..... 446/131, 133–136; 40/426, 406; 273/456; 472/67

[56] References Cited

U.S. PATENT DOCUMENTS

| | | | |
|---|---|---|---|
| 3,239,956 | 3/1966 | Canonica, Jr. | 40/426 |
| 3,425,157 | 2/1969 | Hartsock | 446/134 |
| 5,050,876 | 9/1991 | Chuang | 273/456 |

FOREIGN PATENT DOCUMENTS

| | | | |
|---|---|---|---|
| 12285 | 9/1911 | United Kingdom | 446/134 |

*Primary Examiner*—Mickey Yu

[57] ABSTRACT

A toy fish drive causes one or more toy fish to swim in a natural fashion in a transparent aquarium (viewing tank). A magnetic drive is connected to the external side of the wall or bottom portion of the aquarium and is supported from the side. The drive has two opposite sets of magnets which are rotated to exert magnetic drive forces on a swimming toy fish in the tank, the toy fish containing a magnet and swimming at a selected sinking rate. By means of the attracting force of the magnet in the toy fish, and the action of the magnetic drive forces of the rotating magnets, multiple toy fish are made to swim separately and in different directions simultaneously.

17 Claims, 5 Drawing Sheets

SWIMMING TOY FISH AQUARIUM HAVING MAGNETIC DRIVE SYSTEM FOR MAGNETICALLY DRIVING THE TOY FISH IN THE AQUARIUM

RELATED APPLICATIONS

This application is a continuation-in-part of application Ser. No. 08/226,022 filed Apr. 11, 1994, now U.S. Pat. No. 5,463,826 which is, in turn, a continuation-in-part of application Ser. No. 08/041,566, filed Apr. 2, 1993, now U.S. Pat. No. 5,301,444.

FIELD OF THE INVENTION

This invention relates generally to a display apparatus for animated marine life and is particularly related to a display device comprising a liquid vessel and one or more marine lives swimming freely therein to simulate an aquarium. More particularly, the present invention relates to such aquarium containing one or more magnetically activated toy fish swimming freely in an aquatic habitat much in the same way as a natural fish swims in the sea. In one particular aspect, this invention relates to an aquarium equipped with a magnetic drive system which acts upon one or more toy fish in an aquarium and causes the toy fish to swim freely therein.

BACKGROUND OF THE INVENTION

Magnetically activated animated objects are well known in the art. A magnetically activated toy fish in a display device is described, for example, in U.S. Pat. No. 3,239,956. This patent describes a marine life display apparatus in which an animated toy fish having a magnet therein is freely suspended in a liquid medium and is caused to move about in an effort to simulate the swimming movements of a natural fish. In the display device described in said patent, a power-driven magnetic means is disposed below the liquid medium in which the toy fish is freely suspended, and causes the fish to follow a continuous pattern of undulating movements through the liquid thus simulating the movements of a natural fish.

Other toy fish aquariums and water tanks are described in Japanese Laid-Open Patent 55-101,282 and Japanese Laid-Open Utility Model 60-168,895. These aquariums use rotating magnets whose magnetic force, when exerted on the toy fish, cause the fish to swim freely in the water.

Another type of aquarium for toy fish is described in said copending application Ser. No. 08/226,022, filed Apr. 11, 1994. The device described therein includes a plurality of magnetic field-creating plates, which are rotatably mounted on a rotatable shaft. The shaft is rotated by a motor, thus resulting in rotation of the magnetic plates which then generate magnetic forces which act on the toy fish and cause the fish to move about within the liquid in the tank.

SUMMARY OF THE INVENTION

In accordance with the present invention, there is provided an aquarium which is adapted for use as a viewing tank containing various toy fish such as goldfish, tropical fish, and other comparatively wide oblong toy fish. The viewing tank can be readily assembled by the user and includes a magnetic drive system which is uniquely designed to cause a plurality of fish to move about freely within the liquid in the viewing tank. The magnetic drive system comprises a plurality of spaced apart magnetic plates positioned on an external side wall at the bottom of a transparent fish tank. The magnetic plates are covered by two cover housings which are supported at opposite sides of the tank. The magnets are revolved to exert a driving force on a magnetic toy fish in the tank, which swims at the desired sinking rate. By means of the attracting force of a magnetic member contained in the toy fish, and the action of the magnetic drive forces of the rotating magnets, each toy fish is isolated so that two or more toy fish can be made to swim in a natural fashion, i.e., they swim independently and not in the same direction at the same time.

The magnets are arranged into two sets (left and right) and are positioned on opposite sides of the tank. The two sets of magnets extend their magnetic fields a desired distance into the interior of the tank, within their respective housings, and revolve in opposite directions. A drive force is imparted by the opposing revolving magnets on the magnetic toy fish. The attraction effect of the magnet contained in the toy fish and the magnetic drive force on the side-supported sets of magnets cause each toy fish to swim independently.

The connecting surface of each magnetic drive housing, which connects to the lower half of the tank, is formed as a flat reversed C shape and may be provided with a clasping member which moves in and out to secure the housing to the tank. The two housings are attached to the tank. The swimming toy fish has various swimming actions, with various, rising and sinking variations, caused by the magnetic forces produced by the side-supported magnetic sets, the sinking of the toy fish due to gravity, and its mutual effect with the rotating magnets.

Also, in the tank, the swimming toy fish, which may be attracted or repelled by the magnets within the fish, are instead attracted or pushed apart by the strong revolving magnetic forces of the rotating magnets. The mutual attraction between the fish is thereby cancelled, and the toy fish are separated (to the front, back, left or right) and swim independently of one another. This provides a mode of swimming for the toy fish which is novel.

BRIEF DESCRIPTION OF THE DRAWINGS

The following detailed description should be taken in conjunction with the accompanying drawings. In the drawings, wherein like reference numerals designate like parts.

Similarly.

DETAILED DESCRIPTION OF THE INVENTION

Figure 1:
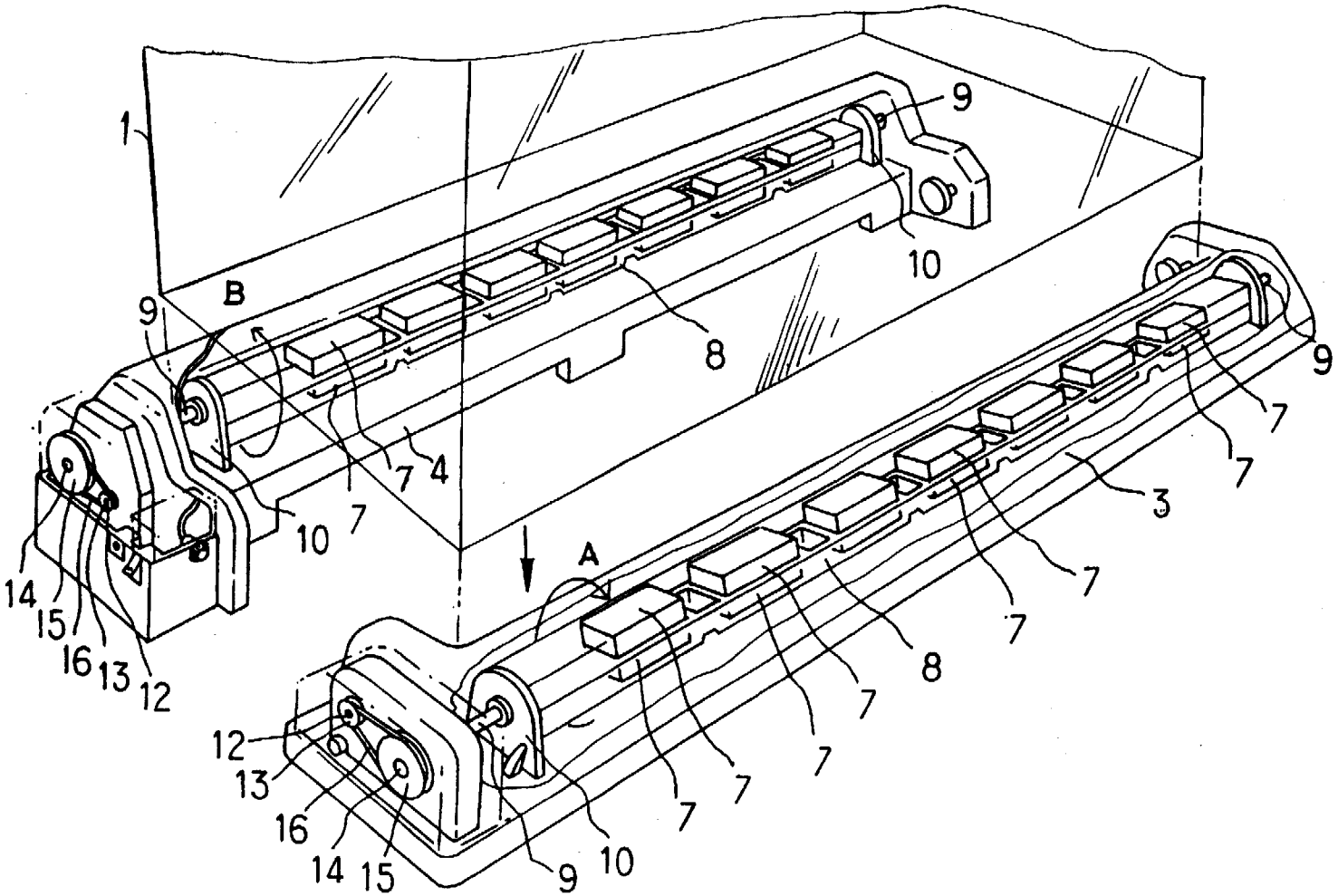
FIG. 1 is an oblique perspective see-through drawing showing the essential features of the swimming toy fish drive device for the viewing tank.

The device of this invention will now be described below by a working example shown in the drawings. The device is comprised of a viewing tank 1, a swimming toy fish 2 which swims in liquid in tank 1, a side one (right side) revolving magnetic drive 3, and a side two (left side) revolving magnetic drive 4. The magnetic drives are placed on the exterior wall surfaces of the tank 1 in opposition to one another.

The tank may be a commercial transparent fish tank used for relatively wide oblong fish such as goldfish, tropical fish and the like. As is shown in FIGS. 1, 2, 3 and 7, a large rectangular transparent glass tank is used, which may be illuminated by an illumination device on top (not shown).

Figure 3:
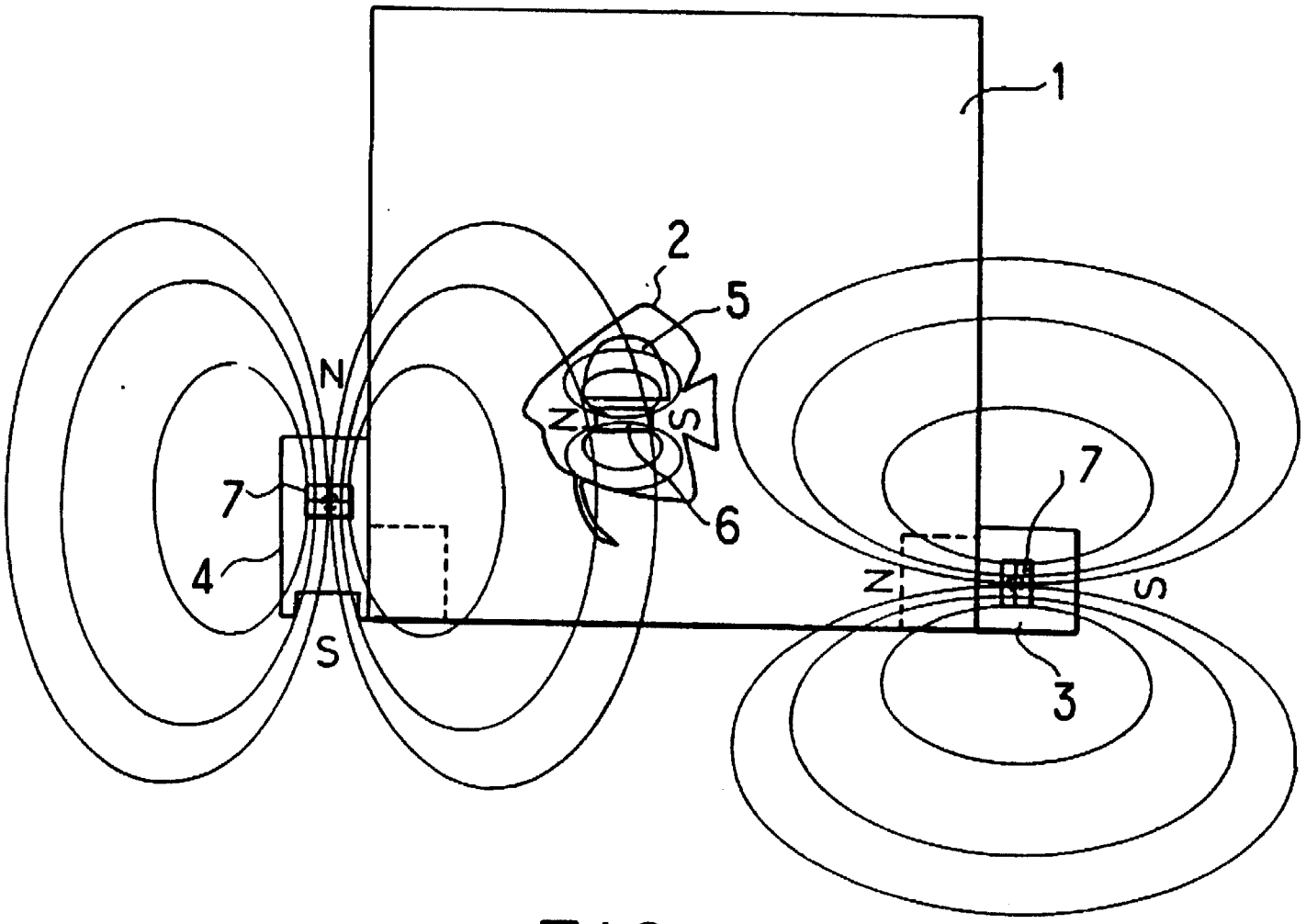
FIG. 3 is a diagram which explains the magnetic force effect of the magnetic drive of the present invention.

The aforementioned swimming toy fish 2, as is shown in FIG. 3, has a buoyancy component 5, and a magnet 6 which also serves as a perpendicular weight. The magnetic poles are directed towards the front and back of the swimming fish body 2. The aforementioned buoyancy component 5 preferably contains an air pocket (not shown). The balance between the buoyancy component 5 and the magnet 6 causes the position of the swimming toy fish 2 to upright itself, and is placed so that the effect of gravity of the toy fish will have the desired sinking rate, i.e., it sinks slowly.

The side one revolving magnetic drive 3, as shown in FIG. 1, has a set of magnets 7, each magnet having N/S poles on both sides and supported, at a desired distance from the next magnet, on a support spindle (shaft) 8 made from a non-magnetic material. On both end of this support spindle 8 are placed support axles 9,9 which are rotatably supported on bearing plates 10,10. Axle 9 is connected to the revolving drive transmission mechanism 11, described below. Support spindle 8 revolves at the desired number of revolutions, and the magnetic forces generated by the magnets, towards the tank, cause a rising revolving action in the direction A (see FIG. 1). Although in the example shown in FIG. 1, two magnets are supported in an opposed up-down configuration, this is done in order to provide a strong magnetic field, i.e., each magnet 7 has an opposite magnet 7 on the other side of the spindle 8. In FIG. 1, the left spindle 8 is rotated counter-clockwise and the right spindle 8 is rotated clockwise.

Figure 4:
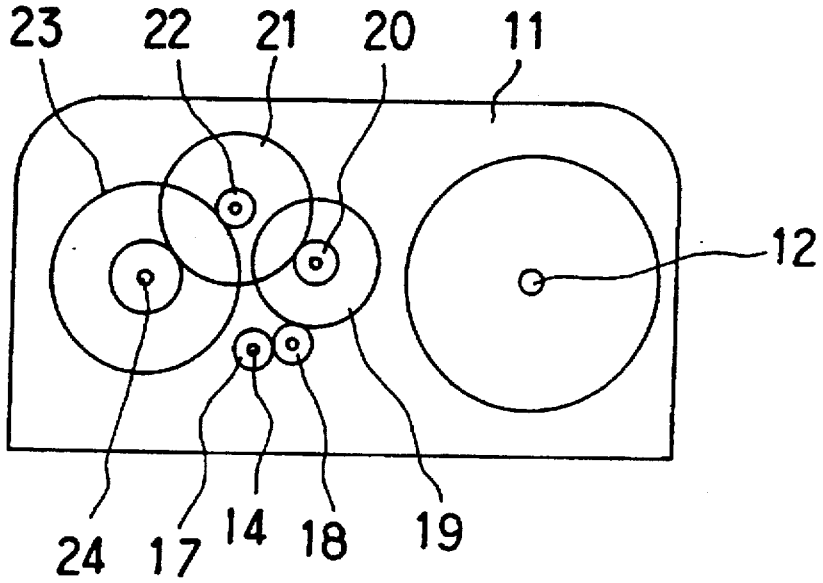
FIG. 4 is a side plan view showing the revolving transmission mechanism of the side-one revolving magnetic force drive.

In the aforementioned revolving transmission mechanism 11, as shown in FIG. 1, a rubber belt 16 drives a small pulley 13 mounted on a motor axle 12, and a large pulley 15 mounted on a large pulley axle 14. As shown in FIG. 4, a motor axle 12 is the output shaft of an electric motor. Preferably there is one motor in each magnetic drive housing. The electric motors may be small AC motors which are connected to household electric power or DC motors operated by a battery (not shown). The pinion 17 on the large pulley axle 14 reverses the rotation by means of the relay pinion 18, to drive the large diameter gear 19 which engages with it. The rate of speed is reduced by a pinion 20 in the center of large diameter gear 19 which engages the large diameter gear 21. A pinion 22, in the center of the large diameter gear 21, engages the large diameter gear 23. The aforementioned support axle 9 is connected to an is driven by the axle 24 on the large diameter gear 23 (when the diameter of the axles is different, a coupling—not shown—is interposed).

Figure 2:
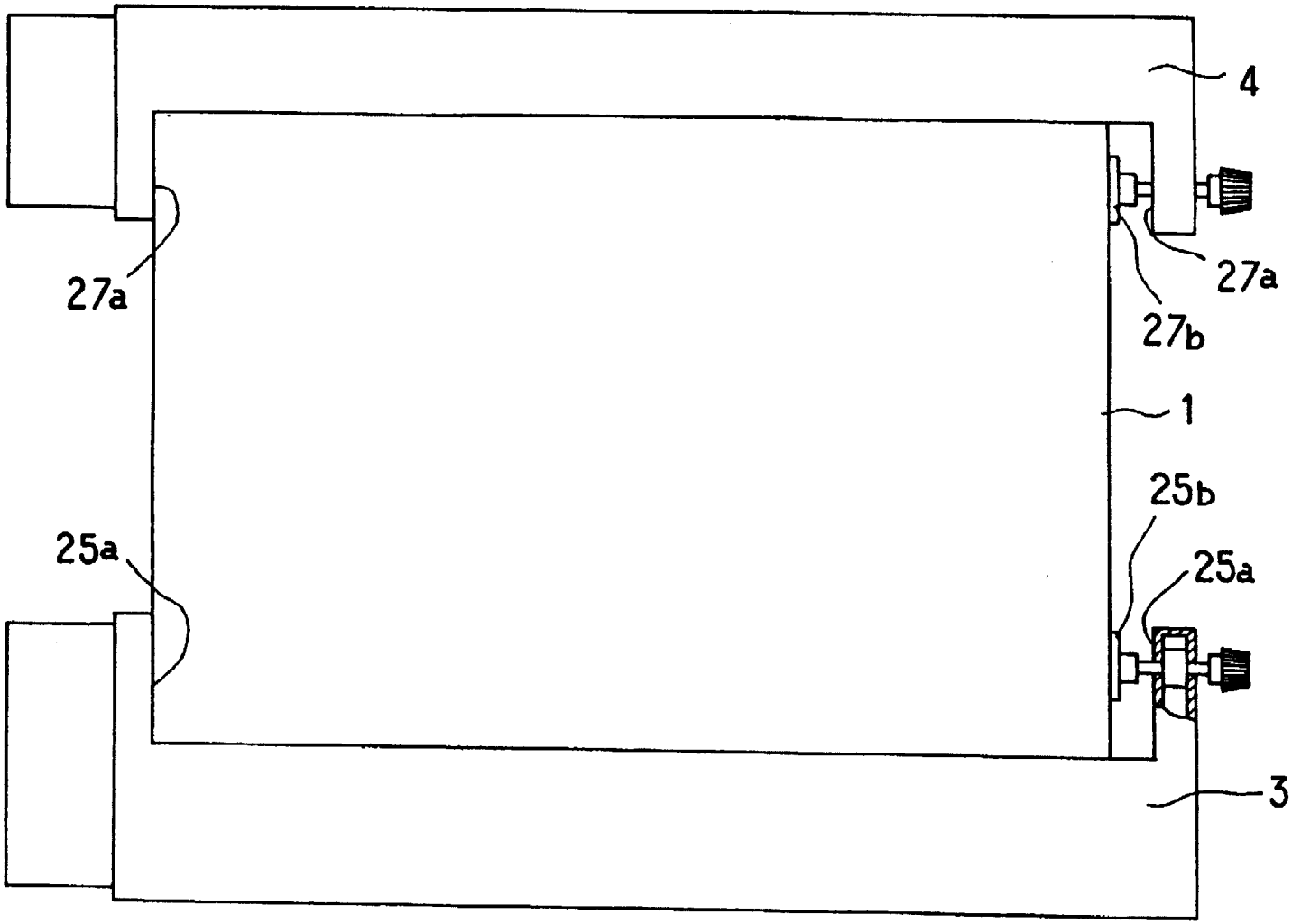
FIG. 2 is an external top plan view, partly cut-away, of the swimming toy drive device and the tank.

In the aforementioned side one (left side) revolving magnetic drive housing 3, the connecting surface is made in a flat reversed C shape, and, as shown in FIG. 2, a clasping component 25*b* moves into and out of the mutually-opposed clasping surfaces 25*a*,25*a*, so as to be able to make a solid connection with the exterior wall of tank 1. The clasping component is extended or retracted by a finger-operated knob.

The aforementioned side two (right side) revolving magnetic drive housing 4, in an identical fashion to the aforementioned side one revolving magnetic drive housing 3, as shown in FIG. 1. Housing 4 has a set of magnets 7, each with N/S poles on both sides, are supported at a desired distance on a support spindle 8 made from a non-magnetic material. On both ends of this support spindle 8 are placed support axles 9,9 which are rotatably supported on bearing plates 10,10. Axle 9 is connected to the revolving drive transmission mechanism 26. Support spindle 8 revolves at the desired number of revolutions, and the magnetic forces generated by the magnets 7 towards the tank 1 is placed so as to cause a rising revolving action in the Direction B.

Figure 5:
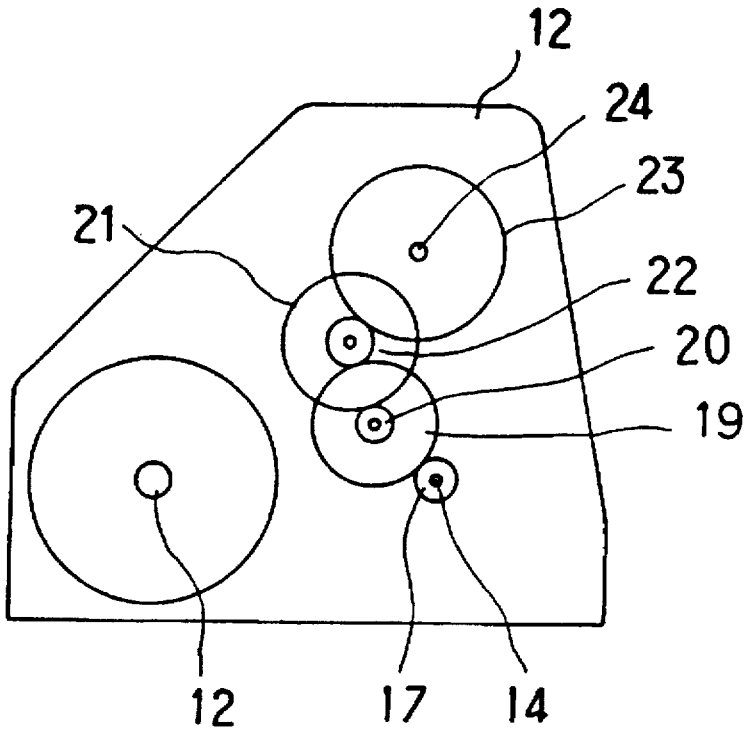
FIG. 5 is a side plan view showing the revolving transmission mechanism of the side-two revolving magnetic drive.
Figure 6:
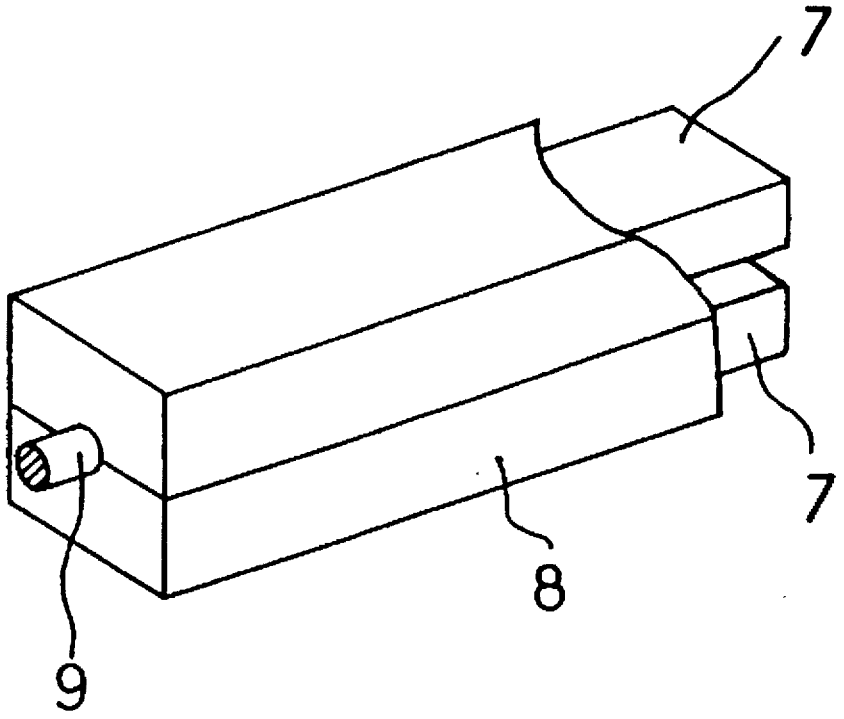
FIG. 6 is a partial oblique perspective view of the end revolving axle portion of the magnetic drive for the side one revolving magnetic drive and for the side two revolving magnetic drive.

In the aforementioned revolving drive transmission mechanism 26, as in shown in FIGS. 1 and 5, in the same manner as the aforementioned revolving drive mechanism 11, a rubber belt 16 drives a small pulley 13 on a motor axle 12 and a large pulley 15 on a large pulley axle 14. The speed is reduced by having large diameter gear 21 engage with pinion 20 in the center of large diameter gear 19. A pinion 22 in the center of large diameter gear 21 engages large diameter gear 23. The aforementioned support axle 9 is connected to and driven by axle 24 on large diameter gear 23 (when the diameter of the axles is different, a coupling—not shown—is interposed).

Similarly, in the aforementioned side two revolving magnetic drive housing 4, the connecting surface is made in a flat reversed C shape, and a clasping component 27*b* moves in and out of the mutually-opposed clasping components 27*a*, 27*a*, so as to be able to make a solid connection with the exterior wall of tank 1.

In the aforementioned side two revolving magnetic drive housing 4, as is shown in FIG. 1, unlike the aforementioned side one revolving magnetic drive housing 3, the position of the support axle 9 is high. When the aforementioned side one revolving magnetic drive 3 is placed on the front side of the tank 1, the revolving magnetic drive of side two revolving magnetic drive, which is placed on the rear side of tank 1 (or left side and right side, respectively) is raised, and a two-stage magnetic field rising effect is imparted to the swimming toy fish 2.

In the aforementioned working example, it was explained that the revolving magnetic driving force device was front and back, or right and left, with reference to the exterior wall of the tank 1, although it may also act to one side only, that is, either to front or back, or to left or right. Also, although not shown, one, two, or more revolving magnetic drive devices may also be placed on the bottom of the tank.

In the device as described above, a magnetic plate is supported sideways on a revolving axle which is opposed to the external wall of a tank, and which is placed so that the magnetic force is generated by the magnetic plate, which rotates around the axis of the revolving axle, causes a rising revolution towards to tank. Since the swimming toy which swims in the tank is given a swimming motion by the rising revolving force of the magnetic forces generated by the magnets. Although the revolving mechanism is simple, the swimming toy fish is given a varied swimming effect by the mutual action of the magnet enclosed in the swimming toy fish and the revolving magnetic fields.

When there are two or more swimming toy fish in the tank, although they are somewhat mutually attracted and separated by their enclosed magnets, they are more attracted or repelled by the strong magnetic forces from the magnetic plates, so as to swim independently of one another (their mutual attraction is cancelled) thus creating multiple modes of swimming, which is novel and unique.

Also, by placing the revolving drive magnets independently, the combination of revolving magnetic fields can be varied in an unlimited way, and when they are opposed towards the front and back of the tank, they cause the swimming of the toy fish to vary in an interesting fashion.

What is claimed is:

1. A swimming toy system comprising:

(a) an aquarium tank and water within the tank, the tank having a bottom wall and opposite side walls;

(b) a toy swimming in the water within said tank, the water toy comprising a body having means to at least partially float the toy body, and a magnet within the body;

(c) a first elongated housing and a second elongated housing, said housings being positioned at the bottom of the tank, on opposite side walls of said tank;

(d) a first magnetic drive within said first elongated housing and a second magnetic drive within said elongated second housing, each magnetic drive comprising a rotatable spindle;

(e) at least one magnetic member having north/south poles mounted on each spindle; and (f) means to rotate the spindle of the first magnetic drive in a clockwise direction and to rotate the spindle of the second magnetic drive in a counter-clockwise direction, to thereby cause the toy to rise and swim in the tank.

2. A swimming toy system as in claim 1 wherein the aquarium tank is transparent and generally rectangular, having four opposite walls.

3. A swimming toy system as in claim 1 wherein the water toy is a toy fish.

4. A swimming toy system as in claim 3 wherein said aquarium contains a plurality of said toy fish which swim independently and in different directions simultaneously.

5. A swimming toy system as in claim 1 wherein each housing includes means to removably fasten the housing onto the tank.

6. A swimming toy system as in claim 1 further including a motor means comprising a first electric motor in the first housing and a second electric motor in the second housing.

7. A swimming toy system as in claim 6 further including a transmission within each housing for driving the spindle in said housing comprising at least a belt, a pinion, a pulley and a gear, and wherein each motor drives each spindle through its respective transmission.

8. A swimming toy system as in claim 1 wherein a plurality of magnets are mounted on each spindle.

9. A swimming toy system as in claim 1 wherein each housing has a connecting surface connected to the tank, each connecting surface having reversed, generally C shape and each housing having a clasp to hold the housing onto the tank.

10. A swimming toy system comprising:

(a) an aquarium tank containing water, said tank having a bottom wall and opposite side walls;

(b) a plurality of water toys adapted to swim in water in said tank, each water toy comprising a toy body having means to at least partially float the toy body, and a magnet within said body;

(c) a first elongated housing and a second elongated housing, each housings being adapted to be positioned proximate the bottom of said tank, on opposite side walls thereof;

(d) a first magnetic drive within the first housing and a second magnetic drive within the second housing, each magnetic drive comprising a rotatable spindle;

(e) means to rotatably mount each spindle;

(f) at least one magnetic member having north/south poles mounted in each spindle; and (g) motor means to rotate the spindle of the first magnetic drive in a clockwise direction and to rotate the spindle of the second magnetic drive opposite thereto in a counter-clockwise direction to thereby cause the water toys to rise and swim in the tank.

11. A swimming toy system as in claim 10 wherein the aquarium tank is transparent and rectangular tank having four opposite walls.

12. A swimming toy system as in claim 10 wherein each water toy is a toy fish and the plurality of toy fish swim independently in different directions.

13. A swimming toy system as in claim 10 wherein each housing is removably secured onto the tank.

14. A swimming toy system as in claim 10 wherein the motor means comprises a first electric motor in the first housing and a second electric motor in the second housing.

15. A swimming toy system as in claim 14 and including a transmission within each housing comprising at least a belt, a pinion, a pulley and a gear and wherein each motor drives each spindle through its respective transmission.

16. A swimming toy system as in claim 10 wherein a plurality of magnets are mounted on each spindle.

17. A swimming toy system as in claim 10 wherein each housing has a connecting surface adapted to be connected to the tank, each connecting surface having a reversed, generally C shape, and means for securing each housing onto the tank.

* * * * *